US005871617A

United States Patent [19]

Iwata et al.

[11] Patent Number: 5,871,617

[45] **Date of Patent: *Feb. 16, 1999**

[54] PAPER MACHINE TWIN-WIRE FORMER WITH DEWATERING LIMITING BLADE DEVICE

[75] Inventors: Hiroshi Iwata, Hiroshima; Takashi Bando; Hiroshi Masuda, both of Mihara, all of Japan

[73] Assignee: Mitsubshi Jukogyo Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 621,341

[22] Filed: Mar. 25, 1996

[30] Foreign Application Priority Data

Mar. 27, 1995 [JP] Japan ..... 7-067895
Aug. 3, 1995 [JP] Japan ..... 7-198720

[51] Int. Cl.[6] ..... D21F 1/54

[52] U.S. Cl. ..... 162/301; 162/300; 162/352

[58] Field of Search ..... 162/300, 301, 162/352

[56] References Cited

U.S. PATENT DOCUMENTS

| | | | |
|---|---|---|---|
| 3,573,159 | 3/1971 | Sepall | 162/352 |
| 3,874,998 | 4/1975 | Johnson | 162/352 |
| 4,321,108 | 3/1982 | Goddard et al. | 162/272 |
| 4,919,760 | 4/1990 | Kerttula | 162/300 |
| 4,999,087 | 3/1991 | Ebihara et al. | 162/301 |
| 5,061,347 | 10/1991 | Bibik et al. | 162/301 |
| 5,078,835 | 1/1992 | Schiel et al. | 162/352 |
| 5,320,713 | 6/1994 | Bubik et al. | 162/301 |
| 5,389,206 | 2/1995 | Buck et al. | 162/301 |

FOREIGN PATENT DOCUMENTS

| | | |
|---|---|---|
| 0 504 123 | 9/1992 | European Pat. Off. . |
| 2-133689 | 5/1990 | Japan . |
| 4-194093 | 7/1992 | Japan . |
| 4-507439 | 12/1993 | Japan . |

*Primary Examiner*—Karen M. Hastings
*Attorney, Agent, or Firm*—Wendertoth, Lind & Ponack, L.L.P.

[57] ABSTRACT

In order to prevent the lowering of yield of fibers of stock which is pinched by two wires and being transferred, specific dewatering blades are disposed on each of the wires are used. Blade sets are disposed on two wires 1, 2 forming loops to pinch stock 7 and running therealong. The blades of one blade set are dewatering limiting blades 20, each having a plane portion 20*a* to support the wires 1, 2 and an inclined face 20*b* disposed on the wire entering side of said plane portion 20*a* and forming a space of a wedge shape facing the wire face and enlarging toward the upstream side in the wire running direction. The blades of the other blade set are dewatering blades 21, each having a plane portion 21*a* to support the wires 1, 2 and an edge 21*b* to scrape water toward the upstream side of said plane portion 21*a*. The plane portion 21*a* having the edge 21*b* is disposed opposite to the space of a wedge shape.

1 Claim, 9 Drawing Sheets

PAPER MACHINE TWIN-WIRE FORMER WITH DEWATERING LIMITING BLADE DEVICE

BACKGROUND OF THE INVENTION

1. Field of the Invention

The present invention relates to a paper machine twin-wire former and a dewatering device to be used for paper layer forming therein.

2. Description of the Prior Art

In a twin-wire former as a paper layer forming device in a conventional paper machine, two wires each form a loop, stock is pinched there between, and as the stock is transferred, it is dewatered by various dewatering devices so that a fiber mat is gradually grown and a web is formed.

In FIG. 10, a construction of a typical twin-wire former is shown, and a paper layer forming device of the twin-wire former is described with reference to FIG. 10.

Stock 7 injected upwardly from a headbox 6 is pinched in a gap 5 of a wedge shape formed by two wires comprising a top wire 1 and a bottom wire 2 guided by a forming roll 4 and a breast roll 3, respectively. As the stock is transferred with the same velocity as the wires 1, 2, the gap 5 is narrowed, and as the stock if further transferred along an approximate curve R on a plurality of dewatering blades 9 arranged on a certain curvature R with intervals between one another on the side of the bottom wire 2, the stock is dewatered toward both sides by a dewatering pressure generated by the dewatering blades 9. A fiber mat is thus gradually grown and a web is formed.

Next, at a suction box 11 and a suction couch roll 12, dewatering by vacuum is performed. At the suction couch roll 12, the web 13 is transferred onto the bottom wire 2 and then is transferred to a next press part by a suction pick-up roll (not shown).

A water deflector 10 is disposed within a wire loop of the top wire 1, so that white water which accompanies the top wire 1 is discharged outside the system therefrom.

Further, in the construction of the twin-wire former shown in FIG. 10, as a countermeasure to meet various problems accompanying the dewatering being done on both sides at the same time, the employment of dewatering limiting shoes (dewatering limiting blades) of the Japanese laid-open patent application No. Hei 2(1990)-133689 as shown in FIG. 11 and a combination of dewatering limiting shoes (dewatering limiting blades) and dewatering shoes (dewatering blades) of the Japanese laid-open patent application No. Hei 4(1992)-194093 as shown in FIG. 12 have been disclosed.

FIG. 13 shows another dewatering device used for paper layer forming in the twin-wire former shown in FIG. 10. That is, FIG. 10 shows an example wherein a dewatering device in which dewatering blades 9 are disposed within one wire loop, or a loop of the bottom wire 2, is mainly used, FIG. 11 shows an example wherein a dewatering device 39 incorporating dewatering limiting blades is provided within one wire loop 32, and FIG. 12 shows an example wherein dewatering limiting blades 59 are disposed within a loop of a first wire 51 and downstream thereof both-side dewatering blades 60 are disposed within a loop of a second wire 52.

In the arrangement of the respective dewatering device shown in FIGS. 10, 11 and 12, the dewatering pressure generated between the wires is decided by the curvature R on which the dewatering blades 9, 39, 59, 60 are mainly arranged, the intervals with which the dewatering blades 9, 39, 59, 60 are disposed, the tensile force of the top wire 1, 31, 51 or of the bottom wire 2, 32, 52, and the dewatering resistance of the fiber mat layer formed between the two wire. There is no function of adjusting the dewatering pressure from the outside during operation.

So, what is shown in FIG. 13 is a dewatering device having the function of adjusting dewatering pressure. Dewatering blades 21 can adjust the pressing force given to the wires from the outside during operation and are disposed opposite to the conventional dewatering blades 9 as shown in FIG. 10 via the bottom wire 2 and the top wire 1.

In a case where the conventional shape of the dewatering blade is used in a mutually opposing dewatering device, the fiber mat layers formed between the wires receive a reaction force via the wires when the wires bend or jerk at the front edge portion of the dewatering blade. The fibers between the fiber mat layers are further moved and dispersed by the force.

But at the same time short fibers (or fine fibers) lose binding with long fibers and there is a strong possibility that the short fibers are washed off together with the water that is to be dewatered by the pressure acting on the mat layers. The yield of the short fibers on the dewatering blade side tends to become worse.

For this reason, countermeasures are taken in which the bending of the wire is made smaller or is shared by the front and rear edge portions. But in this case the fiber dispersion ability of the dewatering blades is lowered and as a result there is a disadvantage that the formation becomes worse.

Further, as the dewatering is done toward both sides, there is a large problem in that the short fibers of the central portion in the thickness direction of the paper layer move toward the outer layer portion, becoming fewer in the middle layer portion. Thus the binding between fibers becomes weaker and the strength in the thickness direction is lowered.

In order to prevent the lowering of the strength in the thickness direction, a countermeasure is taken wherein the dewatering ratio toward both sides is changed by use of the dewatering limiting blades as shown in FIGS. 11 and 12. But there is still no adjusting means to correspond to changes in paper making conditions such as changes of fiber length in the stock, paper making velocity, and alterations of grammage (basis weight).

That is, in the device shown in FIG. 11, it is possible to prevent the washing-off of short fibers, but it is difficult to enhance the dewatering pressure. For this reason there is a disadvantage in that the fiber dispersion ability within the mat layers is not enhanced. Further, in the device shown in FIG. 12, a paper in which a difference in nature between front and rear faces is small can be made by a construction in which both-side dewatering blades are disposed downstream of the dewatering limiting blades disposed immediately downstream of the stock being supplied. Reversely short fibers within the mat layers move to both sides, and there is a disadvantage in that the inner binding strength is lowered.

SUMMARY OF THE INVENTION

It is therefore an object of the present invention to provide a device which can resolve the above-mentioned disadvantages in the prior art and remarkably enhance the quality of paper by improving the yield of short fibers and enhancing the fiber dispersion ability and the strength in the thickness direction.

In order to attain the above object, the present invention relates to a dewatering device in a paper machine twin-wire former in which blades are disposed respectively on two wires forming loops to pinch stock and running therealong. The blades disposed on one wire are dewatering limiting blades, each having a plane portion to support the wires and an inclined face disposed on the wire entering side of the plane portion. They form a space of a wedge shape facing the wire face and enlarging toward the upstream side in the wire running direction. The blades disposed on the other wire are dewatering blades, each having a plane portion to support the wires and an edge to scrape water toward the upstream side of the plane portion. The plane portion having the edge is disposed opposite to the space having the wedge shape.

Each dewatering limiting blade comprises one or more of the inclined face or faces.

Each dewatering blade having the edge is disposed at every two or more of the spaces. Each has the inclined face enlarging toward the upstream side in the wire running direction.

Further, each dewatering blade is supported so that the position of the wire supporting plane is changeable so that at is elastically pressable toward the dewatering limiting blades.

Further, each dewatering limiting blade is supported so that the position of the wire supporting plane is changeable and so that it is elastically pressable toward the dewatering blades.

Further, the dewatering blades are movable in the wire running direction along the curvature on which the dewatering limiting blades are arranged.

Further, each dewatering limiting blade and each dewatering blade are detachable in the width direction.

In the dewatering device according to the present invention, as the dewatering limiting blades and the dewatering blades are arranged with wires inbetween, the bending of wires at each blade end becomes larger than that of the device of FIG. 11, the dewatering pressure caused thereby becomes larger and the fiber dispersion within the mat layers is enhanced. The dewatering is performed in one direction only, and no lowering of the inner binding strength occurs. And as the dewatering is done in direction, the moving resistance of the short fibers is large and the yield of the short fibers is enhanced.

Further, in the dewatering device according to the present invention, as both-side dewatering blades are disposed at a loop portion having a certain curvature, formed immediately downstream of the stock being supplied and the above-mentioned dewatering device is provided further downstream thereof, dewatering is done quickly toward both sides. Strong mat layers are formed quickly, and then dewatering is done in one direction with a large dewatering pressure by the above-mentioned downstream dewatering device. Hence the fiber dispersion within the paper layers is enhanced, washing-out of short fibers does not occur and papers with a large binding strength between the paper layers can be obtained.

DESCRIPTION OF THE PREFERRED EMBODIMENTS

Figure 1:
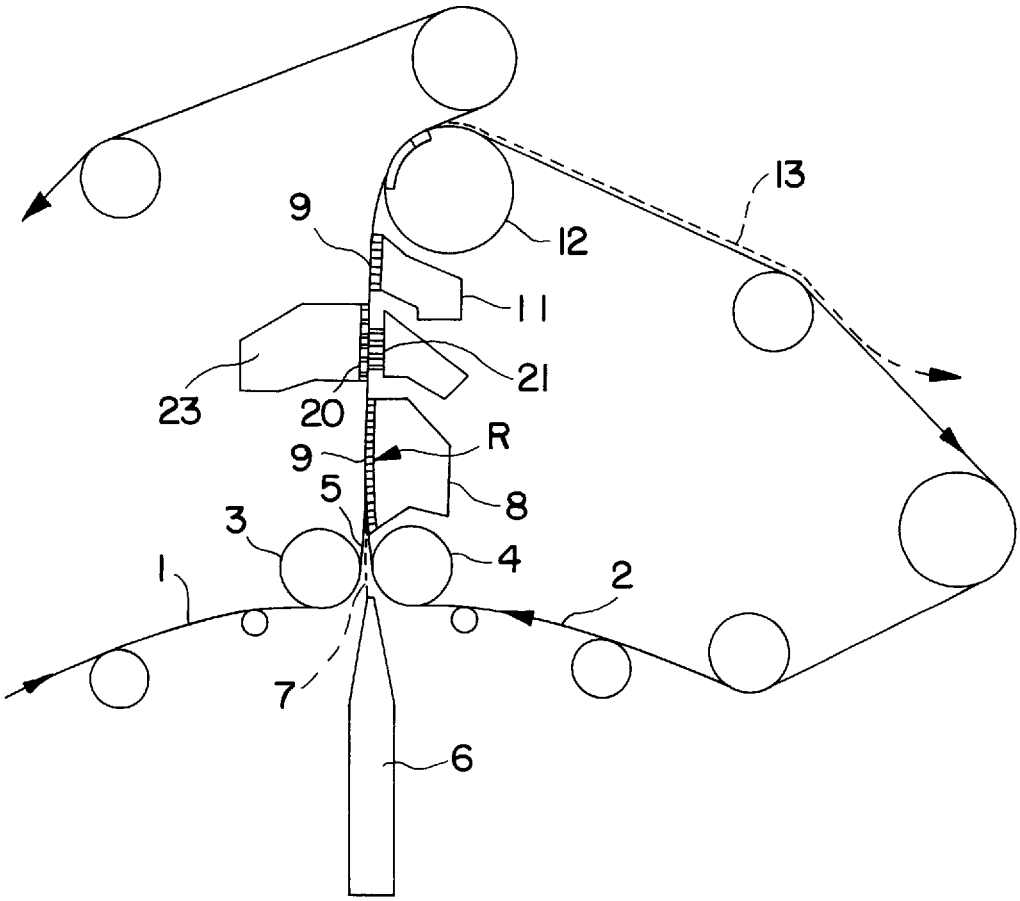
FIG. 1 is a structural view of a twin-wire former according to the present invention.
Figure 2:
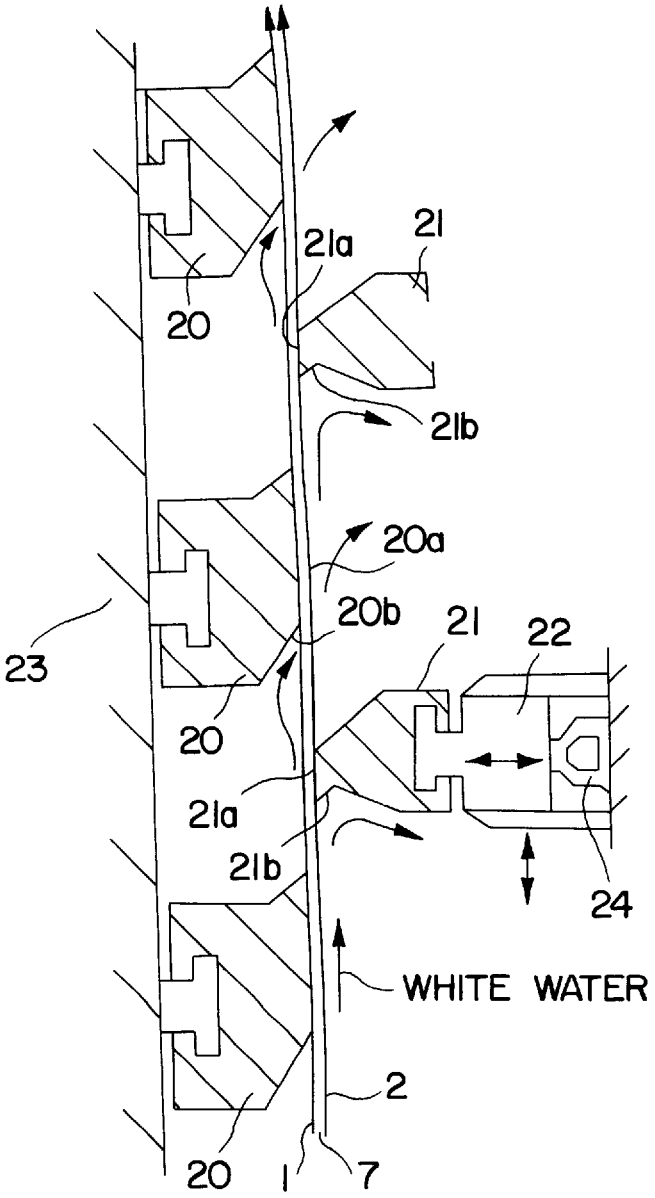
FIG. 2 is a sectional view showing a first preferred embodiment according to the present invention.
Figure 3:
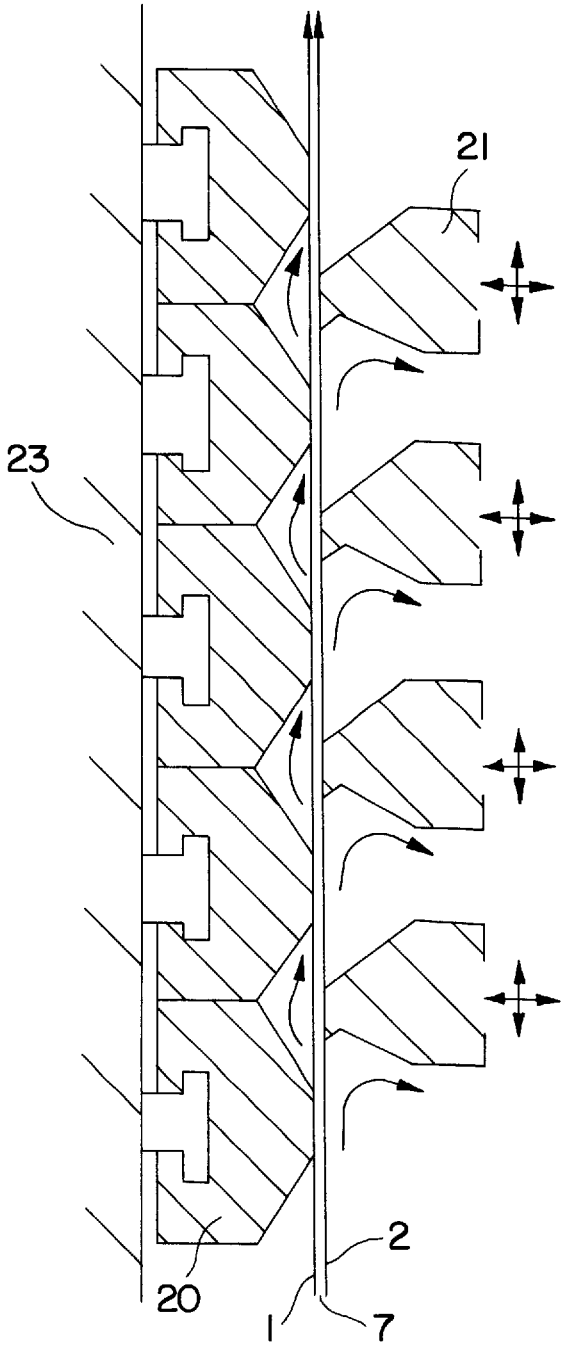
FIG. 3 is a sectional view showing a second preferred embodiment according to the present invention.
Figure 4:
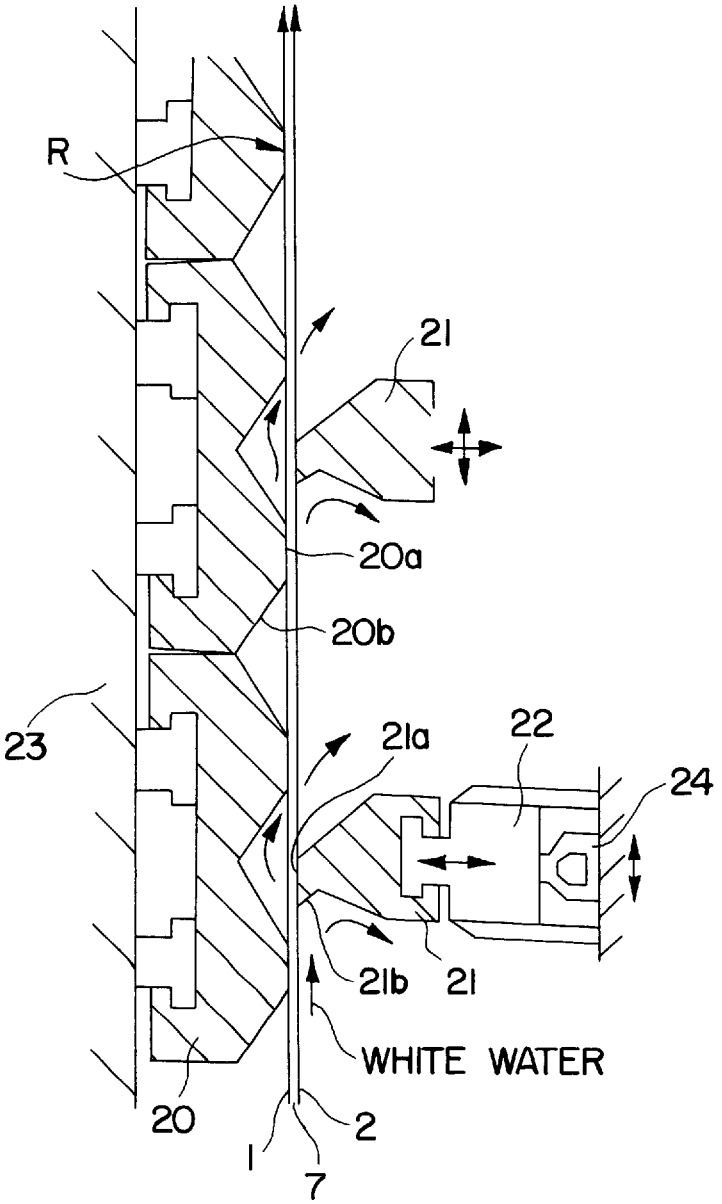
FIG. 4 is a sectional view showing a third preferred embodiment according to the present invention.
Figure 5:
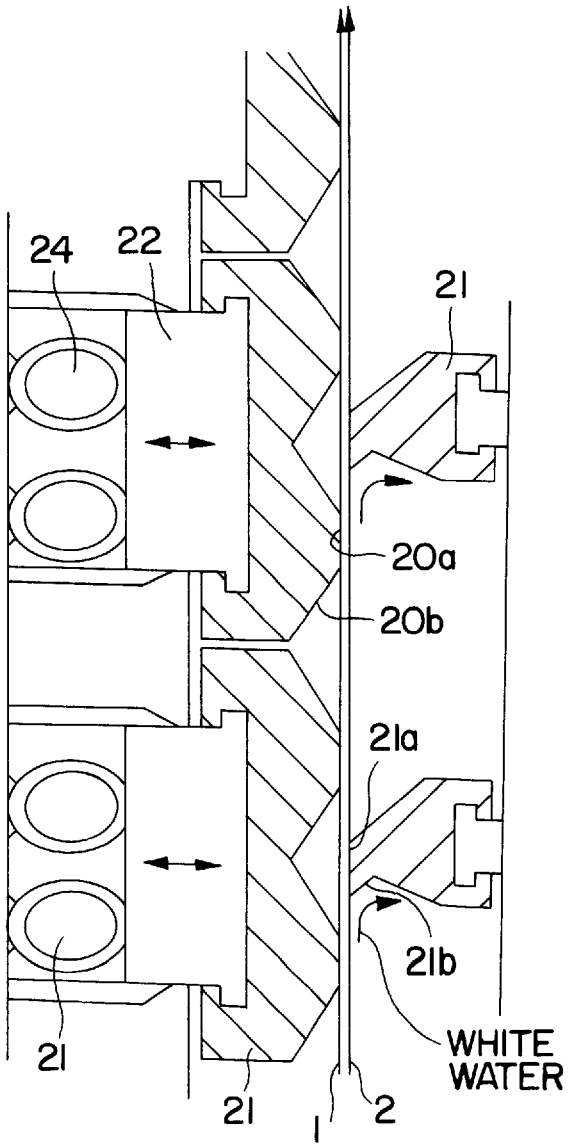
FIG. 5 is a sectional view showing a fourth preferred embodiment according to the present invention.

FIG. 1 is an entire structural view of a paper machine twin-wire former including a dewatering device according to the present invention, FIG. 2 shows a detailed view of a dewatering device as a first preferred embodiment of the present invention, FIG. 3 shows a detailed view of a dewatering device of a second preferred embodiment of the present invention, FIG. 4 shows a detailed view of a dewatering device of a third preferred embodiment of the present invention and FIG. 5 shows a detailed view of a dewatering device of a fourth preferred embodiment of the present invention. FIGS. 6 to 9 are explanatory graphs showing effects of operating the present invention.

Below is a description on the entire structure with reference to FIG. 1 and on the details of a dewatering device according to the present invention with reference to FIG. 2.

One feature of the present invention is that two blade sets are disposed opposite each other and each blade of one blade set has an inclined face forming a space of a wedge shape enlarging toward the upstream side.

Stock 7 injected upwardly from a headbox 6 is pinched in a gap 5 of a wedge shape formed by two wires, a top wire 1 and a bottom wire 2, guided by a breast roll 3 and a forming roll 4, respectively. As the stock is transferred with same velocity as the wires 1, 2, the gap 5 is narrowed. As the stock is further transferred along an approximate curve R on a plurality of dewatering blades 9 arranged on a certain curvature R with intervals between one another on the side of the bottom wire 2, the stock is dewatered toward both sides in an approximately equal amount by dewatering pressure generated by the dewatering blades 9. A dewatering device of the first preferred embodiment of the present invention as shown in FIG. 2 comprises dewatering limiting blades 20, each having a plane portion 20*a* to support the wires within a loop of the top wire 1 and an inclined face 20*b* disposed on the wire entering side of the plane portion 20*a* and forming a space of a wedge shape facing toward the wire face and enlarging toward the upstream side in the wire running direction. Dewatering blades 21. Each has a plane portion 21*a* to support the wires within a loop of the bottom wire 2 and an edge 21*b* to scrape water toward the upstream side of the plane portion 21*a*. The dewatering blades 21 are elastically pressable toward the dewatering limiting blades 20, which are disposed opposite to the dewatering blades 21 via the wires 1, 2. By use of the dewatering blades 21, the pressing force is controlled from the outside so that an appropriate fiber dispersion action is given and fiber mat layers are gradually formed between the two wires.

Then, a web 13 is dewatered by vacuum at a suction box 11 and a suction couch roll 12 and is further transferred to a next press part by a suction pick-up roll (not shown).

In FIG. 2, the wires 1, 2 pinching the stock 7 bend at the line position where the inclined face 20*b* forming the wedge shaped space enlarging toward the upstream side and the wire supporting plane 20*a* meet so that a pressure (static pressure) is generated between the wires 1, 2. Dewatering is done through the bottom wire 2, and white water (shown in the figure) by arrows flows out. The white water then accompanies the wire 2 and is discharged outside the system by the dewatering blades 21, having the edge 21*b* to scrape water toward the upstream side, disposed within the loop of the bottom wire 2.

The dewatering blades 21 are supported so that their relative position to the wire is changeable and the pressing force can be changed by adjusting the pressure of fluid (air, water, oil etc.) to be supplied to flexible tubes 24. Thereby, the stock 7, pinched between the wires 1, 2 and being transferred, is elastically pressed, the bending of the wires 1, 2 is freely changed from the outside and the pressure (static pressure) between the wires can be controlled.

The white water which is discharged to the side of the top wire 1 enters the wedge portion of the upstream side of the dewatering limiting blade 20 disposed within the loop of the top wire 1 and generates a wedge pressure. Thus dewatering to the side of the top wire 1 by a static pressure generated at the dewatering limiting blades 20 can be limited.

FIG. 3 shows a construction in which the dewatering limiting blades 20 are arranged without intervals therebetween within the loop of the top wire 1, and there occurs no dewatering to the side of the top wire 1.

As each dewatering limiting blade 20 and each dewatering blade 21 are constructed so as to be detachable in the width direction, the blade intervals of the dewatering limiting blades 20 or the dewatering blades 21 can be the pressing force of the dewatering blades 21 adjusted. Thereby sharing of the amount of dewatering by the top wire 1 side and the bottom wire 2 side, or their dewatering ability, can be easily adjusted.

Further, as it is apparent as mentioned above that the generation of dewatering pressure by these mutually opposing dewatering limiting blades 20 and dewatering blades 21 is greatly influenced by the degree of bending of the wires, the dewatering blades are moved in the wire running direction along the curvature on which the dewatering limiting blades are arranged. Thereby also the degree of bending of the wires is also changed and the sharing of the amount of dewatering and dewatering ability can be adjusted.

The shape of the inclined face formed the space of a wedge shape of the dewatering limiting blade can be a plane, or the face can be formed by a concave or convex curve or a compound curvature in the running direction cross section.

A third preferred embodiment according to the present invention is shown in FIG. 4. The dewatering limiting blade 20 has two inclined faces forming spaces of a a wedge shape enlarging toward the upstream side. The two spaces of a wedge shape disposed at these dewatering limiting blades generate a pressure acting on the stock 7 by the bending of the wires there, and can prevent the fibers from flocculating each other. There can be two or more of the inclined faces and the spaces of a wedge shape.

A fourth preferred embodiment according to the present invention is shown in FIG. 5, wherein, contrary to FIG. 4, the dewatering blades 21 are fixed and the dewatering limiting blades 20 are movable.

As described above, the present invention has a feature in that a blade set is disposed respectively on two wires and the blades of one blade set are dewatering limiting blades, each having a plane portion to support the wires and an inclined face disposed on the wire entering side of the plane portion and forming a space of a wedge shape facing the wire face and enlarging toward the upstream side in the wire running direction. The blades of the other blade set are dewatering blades, each having a plane portion to support the wires and an edge to scrape water toward the upstream side of the plane portion. The plane portion having the edge is disposed the opposite to the space of a wedge shape. Thereby dewatering pressure can be made larger, the fiber dispersion ability within the mat layers is enhanced, dewatering is done toward in one direction only, the inner binding strength is high and the yield of short fibers is enhanced.

Both-side dewatering blades are disposed at a loop portion, having a certain curvature, immediately downstream of the stock being supplied. The above-mentioned dewatering device is provided further downstream thereof and thereby the above-mentioned effects can be further clearly obtained.

Figure 6:
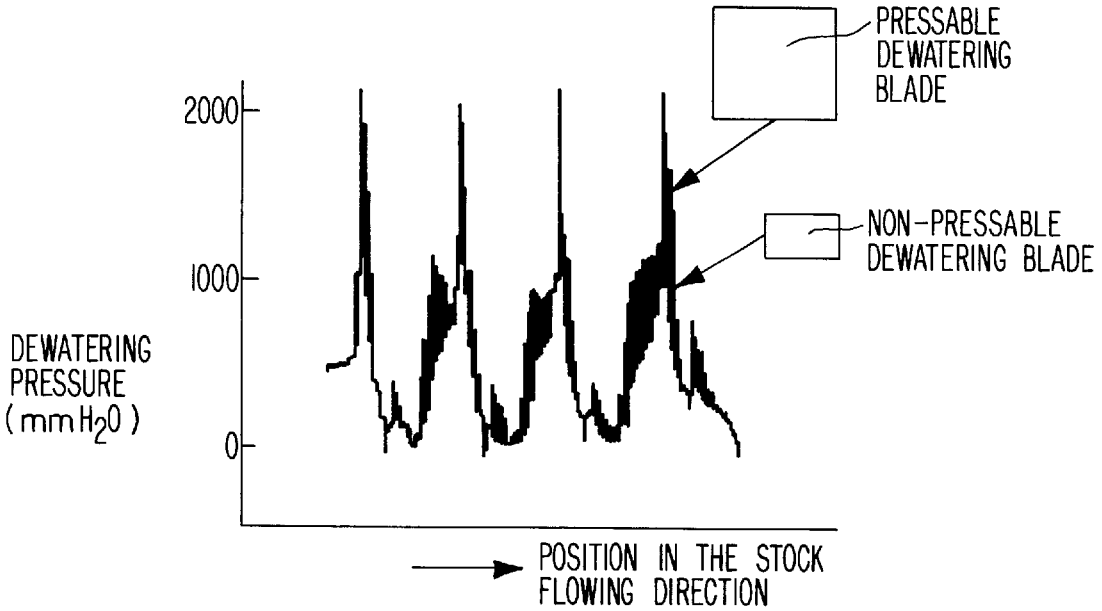
FIG. 6 is an explanatory graph of the adjustability of dewatering pressure with the present invention.

Further, as one of the dewatering limiting blade or the dewatering blade is elastically pressable, the dewatering pressure between the two wires can be adjusted within the black colored area shown in FIG. 6. The upper limit is the case of the dewatering blade being pressable and the lower limit is the case of the dewatering blade not being pressable, or the case of the dewatering limiting blade only being provided. Hence, according to the present invention, a more flexible operation to meet the paper making velocity, grammage (basis weight) and stock conditions becomes possible.

Figure 8:
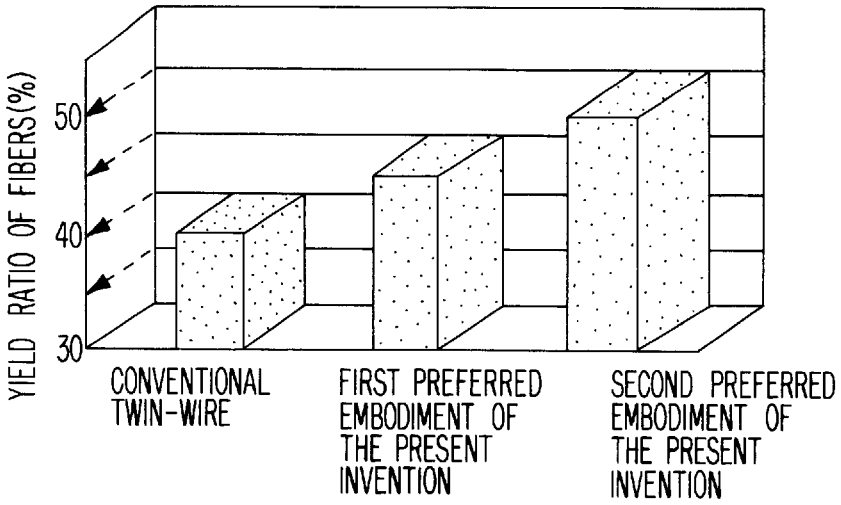
FIG. 8 is an explanatory graph showing examples of the enhancement of the fiber yield rate.

As a result, in the present invention, dewatering on one side is limited and a high pressure pulse can be obtained even with a small bending of the wires at the blade edge portion. Hence the yield ratio of fibers is remarkably enhanced, as shown in FIG. 8, wherein preferred embodiments according to the present invention and a conventional twin-wire former, in which no pressable dewatering blade is disposed opposite to the dewatering limiting blade, are compared. Thus, according to the present invention, there is no lowering of the yield of short fibers.

Figure 7:
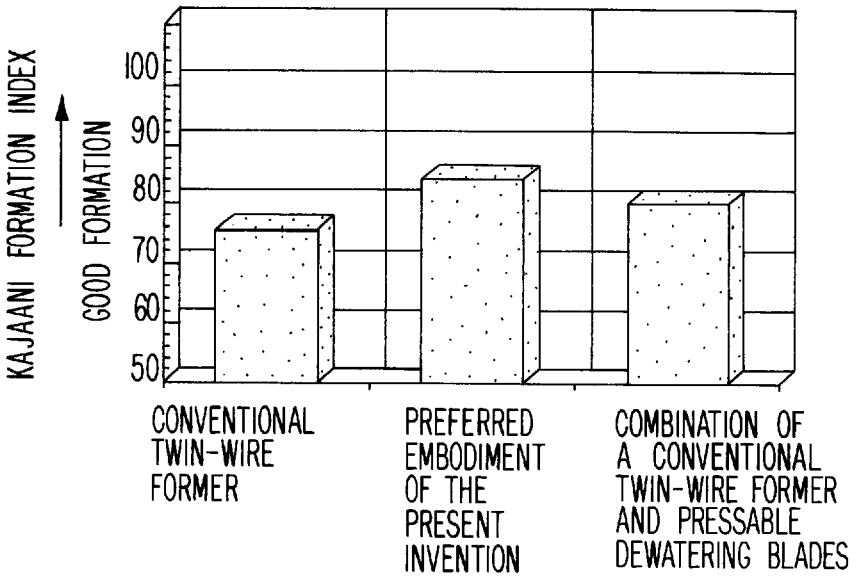
FIG. 7 is an explanatory graph showing effects of formation improvement according to the present invention by comparison.

Further, an evaluation of the formation in a preferred embodiment according to the present invention, as compared with the conventional twin-wire former and of another conventional twin-wire former in which pressable dewatering blades are disposed, although not opposite to dewatering limiting blades, is shown in FIG. 7. It is found that a good formation (good fiber dispersion state) can be obtained according to the present invention and the movement of short fibers within mat inner layers to the outer layers becomes less.

Figure 9:
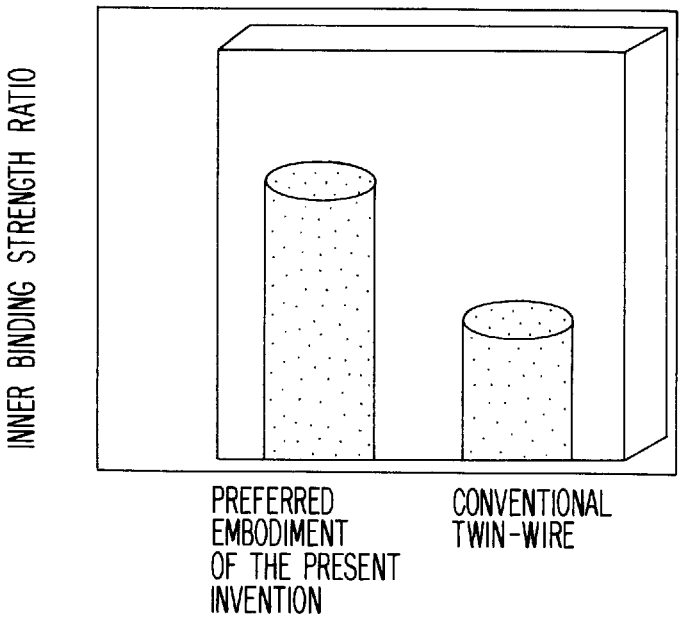
FIG. 9 is an explanatory graph showing the effect of the inner binding strength according to the present invention by comparison.
Figure 10:
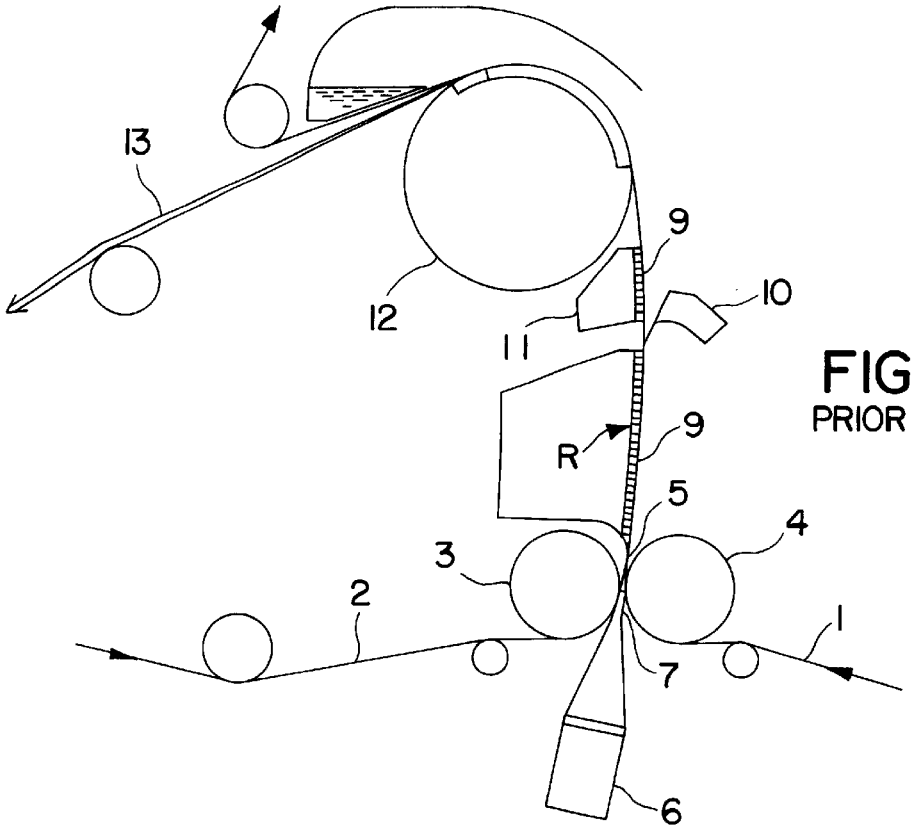
FIG. 10 PRIOR ART
FIG. 10 is a structural view of a twin-wire former in the prior art.
Figure 11:
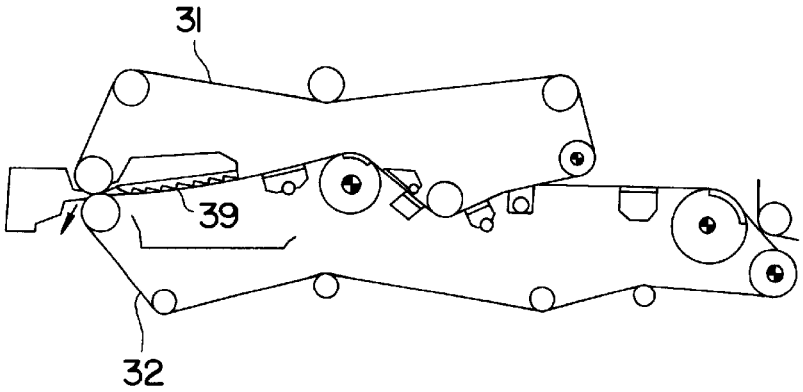
FIG. 11 PRIOR ART
FIG. 11 is a structural view of a twin-wire former in the prior art in which dewatering blades are replaced with dewatering limiting blades (Japanese laid-open patent application No. Hei 2-133689).
Figure 12:
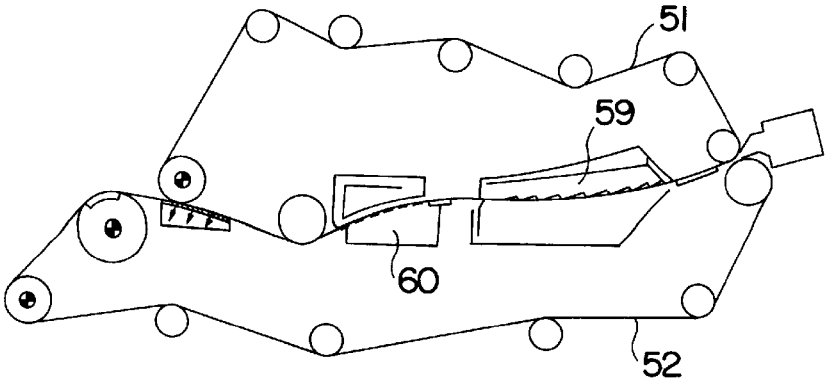
FIG. 12 PRIOR ART
FIG. 12 is a structural view of a twin-wire former in the prior art in which dewatering blades and dewatering limiting blades are combined (Japanese laid-open patent application No. Hei 4-194093).
Figure 13:
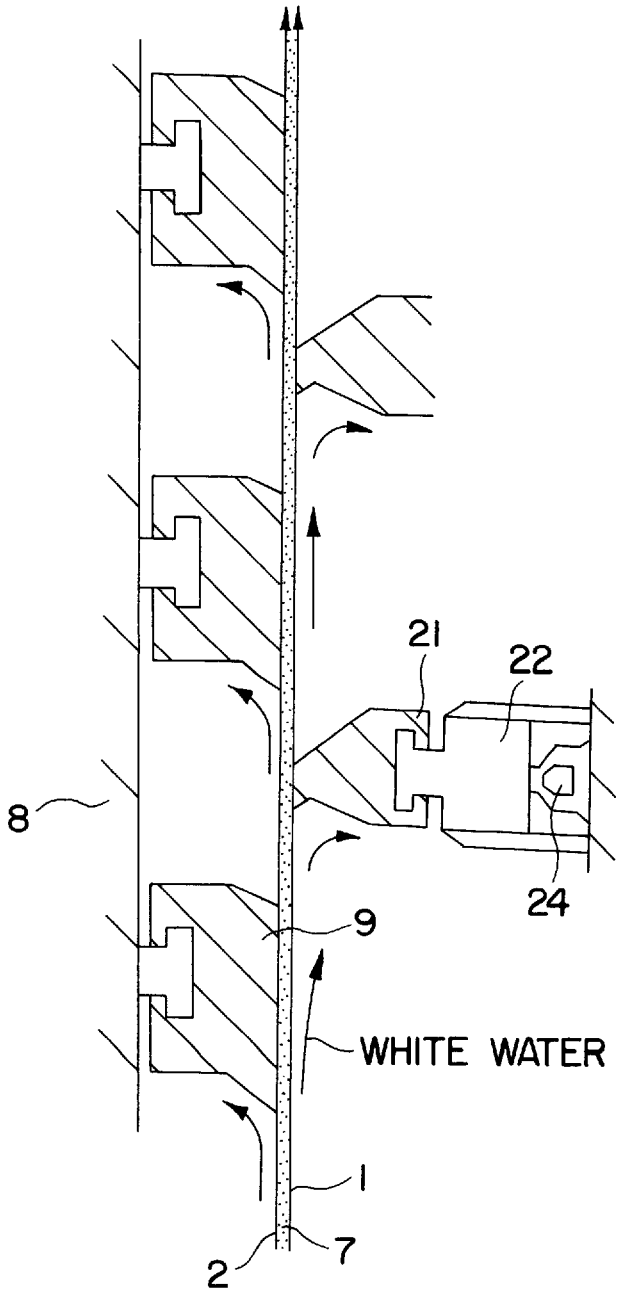
FIG. 13 PRIOR ART
FIG. 13 is a sectional view showing a conventional example.

Furthermore, as shown in FIG. 9, as compared with the conventional twin-wire in which pressable dewatering blades are not disposed opposite to dewatering limiting blades, an enhanced inner strength can be obtained by the present invention. All these effects that the present invention brings on are revealed by a series of researches and tests performed by the present inventors.

While the preferred form of the present invention has been described, variations thereto will occur to those skilled in the art within the scope of the present inventive concepts which are delineated by the following claims.

What is claimed is:

1. A dewatering device in a paper machine twin-wire former having two wires forming loops, the loops having an upstream wire running direction and a downstream wire running direction, and said dewatering device comprising:

blades disposed on the two wires for pinching stock running between the loops, said blades comprising dewatering limiting blades disposed on one of the two wires which each comprises a first plane portion engaging and supporting the one of the two wires and an inclined face disposed upstream of said first plane portion and, together with the one of the two wires, forming a first wedge shaped space that increases in size in the upstream wire running direction, and comprises one further inclined face thereon that together with the one of the two wires forms a second wedge shaped space, that decreases in size in the upstream running direction, said first and second wedge shaped spaces forming a coextensive space, and dewatering blades disposed on the other of the two wires which each comprises a second plane portion engaging and supporting the other of the two wires and a water scraping edge portion disposed upstream of said second plane portion;

wherein said second plane portions of said dewatering blades are alternated in contact with the other of the two wires so as to have non-contact areas therebetween along the other of the two wires that are not contacted by said second plane portions, and said first plane portions of said dewatering limiting blades contact the one of the two wires at positions opposite to said non-contact areas such that said first and second plane portions are not positioned opposite to each other and such that each of said second plane portions is opposite one of said coextensive spaces.

* * * * *